United States Patent [19]

Winters et al.

[11] 4,283,427

[45] Aug. 11, 1981

[54] MICROWAVE HEATING PACKAGE, METHOD AND SUSCEPTOR COMPOSITION

[75] Inventors: William C. Winters, Bloomington; Hsien-Hsin Chang, Minneapolis; George R. Anderson, Minneapolis; Ross A. Easter, Minneapolis; Jeffrey J. Sholl, New Brighton, all of Minn.

[73] Assignee: The Pillsbury Company, Minneapolis, Minn.

[21] Appl. No.: 970,898

[22] Filed: Dec. 19, 1978

[51] Int. Cl.[3] ..... H05B 6/64

[52] U.S. Cl. ..... 426/107; 219/10.55 R; 219/10.55 E; 219/10.55 M; 252/1; 252/600; 426/234; 206/524.1; 206/524.3; 206/525

[58] Field of Search ..... 252/70, 600, 1; 219/10.55 E, 10.55 M, 10.55 R; 426/107, 234, 241, 242, 243; 126/400; 206/524.1, 524.3, 525

[56] References Cited

U.S. PATENT DOCUMENTS

| | | | |
|---|---|---|---|
| 2,640,478 | 6/1953 | Flournoy | 126/400 X |
| 2,830,162 | 4/1958 | Copson et al. | 219/10.55 E |
| 3,256,101 | 6/1966 | Arns | 219/10.55 M X |
| 3,605,720 | 9/1971 | Mayo | 126/400 X |
| 3,720,198 | 3/1973 | Laing et al. | 126/400 |
| 3,771,234 | 11/1973 | Forster et al. | 219/10.55 M X |
| 3,859,493 | 1/1975 | Peterson | 219/10.55 M X |
| 3,974,354 | 8/1976 | Long | 219/10.55 E |
| 3,985,991 | 10/1976 | Levinson | 219/10.55 E |
| 3,986,969 | 10/1976 | Telkes | 252/70 |
| 4,190,757 | 2/1980 | Turpin et al. | 426/107 X |

FOREIGN PATENT DOCUMENTS

| | | | |
|---|---|---|---|
| 2631320 | 1/1978 | Fed. Rep. of Germany | 252/70 |
| 2001096 | 1/1979 | United Kingdom | 252/70 |

*Primary Examiner*—Harris A. Pitlick

*Attorney, Agent, or Firm*—Robert J. Lewis; Michael D. Ellwein

[57] ABSTRACT

A microwave heating package, and a method of microwave heating. Both the package and the method employ a lossy chemical susceptor which upon continued exposure to microwave radiation becomes substantially microwave transparent, thus building into the system a unique maximum temperature shut off at the point at which the chemical susceptor becomes microwave transparent. The chemical susceptor is comprised of a combination of a solute, such as inorganic salts of Group IA and IIA, and a polar solvent for the solute, such as water. The chemical susceptor may be composed of a hydrated form of the inorganic salts. The package, method and chemical susceptor may be used for microwave heating of many products, including among others, food products.

40 Claims, 7 Drawing Figures

MICROWAVE HEATING PACKAGE, METHOD AND SUSCEPTOR COMPOSITION

BACKGROUND OF THE INVENTION

This invention relates generally to the art of the microwave heating by high frequency electromagnetic radiation, or microwave energy. The invention has broad utility in microwave heating of a multitude of materials, including food products.

Microwave heating offers certain advantages over other heating techniques. For example, it heats fast, efficiently and is penetrating, making it possible to heat products, such as foods, rapidly throughout. This is particularly valuable in the food art for consumer cooking or reheating of previously prepared foods. It also may be utilized in other arts wherein fast heating and drying of products are desired; for example, in the construction industry for rapid drying of concrete, lumber drying, textiles, rubber, ceramics or the like.

In the past few years, microwave heating has enjoyed considerable popularity with the public, primarily due to convenience factors stemming from the rapid heating rates which can be achieved.

However, while microwave heating is currently enjoying considerable popularity, it also has some deficiencies which would make it even more desirable if the deficiencies could be overcome. Amongst these deficiencies are lack of uniformity of heating throughout an entire product, the inability to successfully crisp or brown surfaces of food products such as pizza, pie crust, breads, meat pies, crispy snack foods, biscuits, french fries, and the like. Indeed, one common occurrence when temperatures are elevated sufficiently high to crisp or brown will be over-cooking, scorching, charring or burning of portions of the product. This, of course, does not meet with public acceptability. Conversely, if microwave heating is accomplished at lower temperatures, below the temperatures needed for crisping or browning, often internal portions of the food product do not become totally cooked, and moisture is driven towards the outer surfaces of the product and remains there, giving an overall impression of sogginess. This is not desirable.

As is understood, by those skilled in the art of microwave heating, the ability or lack of ability of any given material to absorb microwave energy and convert that to heat energy is measured in terms of the lossy characteristics of the substance. Substances which will absorb microwave energy and convert it to heat energy are known as "lossy". On the other hand, substances which will not absorb microwave energy are said to be non-lossy or microwave transparent.

Particularly in the food art, one approach to solving the dilemma expressed above in order to provide browning and crisping of surfaces is to provide a heating vessel which has, at least on one surface of the vessel, a lossy heater. Such heaters are in reality materials highly susceptible to microwave absorption and heat conversion, and being very lossy, the result is that these surfaces heat to a substantially elevated temperature. Thus, portions of a food product which are in thermal contact with such surfaces will be heated to a substantially elevated temperature in comparison with the bulk of the food product, resulting in browning or crisping.

Examples of such ceramic heaters include ferrites, semiconductors, and the like. For an example of a cooking vessel employing a lossy ceramic heater, see Sumi, et al., U.S. Pat. No. 3,941,967, which teaches a microwave cooker of the casserole type. The vessel is permanent, non-disposable in nature, and employs a ferrite ceramic heating element. Examples of ferrite ceramic heating elements include nickle zinc ferrite, magnesium zinc ferrite, barium ferrite, and strontium ferrite.

While such ceramics have met with some success as heating elements for use with microwave energy, they also have considerable drawbacks. Ceramic heating elements are expensive; they add considerable bulk and weight to packaged products and do not readily lend themselves to employment with disposable non-permanent packaging materials; and, perhaps most importantly, ceramic heating elements may provide for uncontrolled (run away) heating to elevated temperatures. This often results in scorching, charring and burning.

Another example of a lossy heater often used is tin oxide, a semiconductor heater on a glass substrate. These are massive and have the same general deficiencies as the ceramic heaters.

Thus, in summary, while ceramic and semiconductor heaters certainly have their place in microwave technology, they also have considerable deficiencies for some uses. Among those deficiencies are expense, and a seeming inability to regulate and control maximum temperature achieved.

The invention relates to the development of an entirely new class of microwave heater materials. The materials suitable for use in this invention have a unique capability of initially being lossy, and after continued exposure to microwave energy, they reach a certain elevated maximum temperature, at which time, due to either chemical or physical phenomena or a combination of both, they become non-lossy and substantially microwave transparent. As a result, the temperature-time profile of microwave heating can be substantially predetermined; the maximum temperature achievable can be determined and predicted, and the microwave absorber can be "tailor made" for a particular heating job.

The materials which are usable will be explained in detail in the Description of the Invention which follows; however, they are referred to herein as "chemical susceptors". As used here, the term "susceptor" or "susceptor device" refers to a device for converting microwave energy into heat which in turn heats another article placed on or nearby the susceptor. To be efficient, the susceptor should heat more rapidly in the microwave field than the article to which its thermal energy is to be transferred. The term "chemical susceptor" as utilized herein means material which is initially lossy and which upon continued exposure to microwave energy, reaches a certain, ascertainable maximum temperature and thereafter becomes substantially non-lossy, or microwave transparent.

Accordingly, one object of this invention is to provide an entirely new class of microwave lossy materials which are initially lossy at ambient temperature and which eventually upon continued heating by exposure to microwave energy, become substantially non-lossy.

Another object of this invention is to provide an entirely new class of non-ceramic chemical susceptors usable for microwave heating of almost any product material, including foods.

Another object of this invention is to provide a new and unique method of providing a desired heating profile in a microwave field by manipulation of the formulation of a chemical susceptor.

Yet another object of this invention is to provide a disposable microwave heating package which employs the chemical susceptors of this invention.

A still further object of this invention is to provide a disposable microwave heating package which does not employ ceramic lossy absorbers, and which can be effectively used for selective dehydration of surfaces of a product to be treated to provide browning, crisping or the like.

Yet another object of this invention is to provide a microwave heating package which is inexpensive, flexible and disposable, and also which is particularly adapted for use as a carton for vending machine use.

A yet further object of this invention is to provide regulation of heat load for a packaged food product by formulating the product to increase or maximize the ability to heat rapidly.

The manner and method of accomplishing each of the above stated objects, as well as others, will be apparent from the description which follows.

SUMMARY OF THE INVENTION

Figure 1:
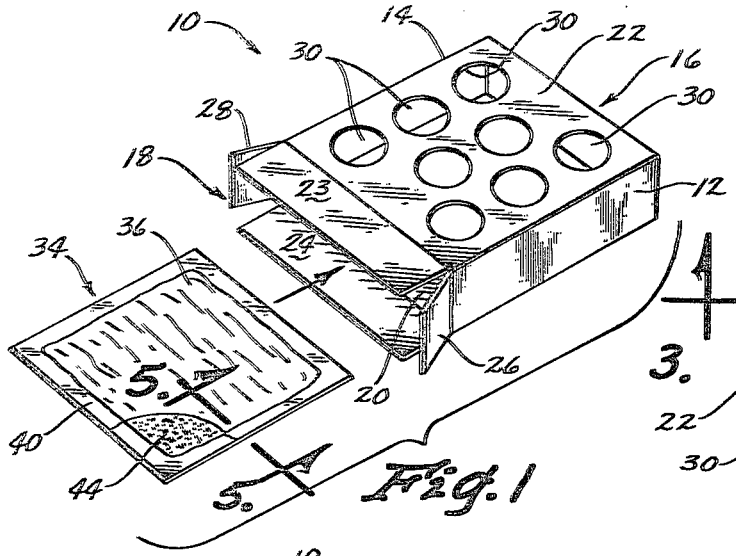
FIG. 1 is a perspective view of a typical disposable package which employs the chemical susceptor of this invention.

This invention relates to a lossy chemical susceptor for microwave energy, which upon continued exposure to microwave radiation eventually becomes substantially microwave transparent. The chemical susceptor is comprised of a combination of a solute and a polar solvent for the solute, with the amount of solute present being as a minimum an amount sufficient to provide a saturated solution of the solute in the solvent, and further an amount which will depress the vapor pressure of the solvent at least by 25% and preferably about 30% when compared to the solvent's boiling point at standard pressure.

The solutes which may be employed in this invention include a wide variety of inorganic salt materials, any of which are Group IA and Group IIA salts, but also include for an example, iron from Group VIIIB. A common characteristic of most, but not all, of the salts is that they readily from hydrates, or, in the case of non-water solvents, solvates. It is therefore to be understood that it is contemplated in this invention that the polar solvent may be present in a hydrated (solvated) form. The most commonly available and usable polar solvent for this invention is water, although others may be employed as well.

The invention also relates to a method of microwave heating wherein the heating profile of a product within a microwave field can be predetermined or carefully regulated and controlled to provide almost any desired heating profile by manipulation of the formulation of the chemical susceptor.

The susceptors of this invention are also readily adaptable to preparing disposable microwave packages and the invention relates as well to such packages.

DETAILED DESCRIPTION OF THE INVENTION

As heretobefore mentioned, one aspect of the invention is the development of a new class of non-ceramic lossy chemical susceptors for microwave energy. These chemical susceptors can be broadly categorized as chemical susceptors which upon continued exposure to microwave radiation become substantially microwave transparent. Moreover, the heating (time-temperature) profile within a microwave radiation or energy environment can be carefully regulated by manipulation of the formulation of the chemical susceptors.

The chemical susceptor in its broadcast aspect comprises a two-component system comprised of a solute material and a polar solvent for the solute material. In a preferred aspect of the invention an additional embodiment known as a heating profile modifier can also be employed in the formulation.

The solute material selected must be one which is, of course, soluble in the polar solvent. Further, it must be present in an amount sufficient that it will depress the vapor pressure of the solvent at least 25% and preferably at least about 30% when compared to the solvent's boiling point at standard pressure. More preferably the solute is one which will depress the vapor pressure of the solvent at its boiling point at standard pressure by at least about 50%. Even more preferred are highly soluble solutes which will provide vapor pressure depression of at least about 70% and most preferred in the range of between about 70% to about 80%. The data showing vapor pressure depression, as those skilled in the art know, are available in such standard references as the International Critical Tables; see also, Seidell & Linke, *Solubility of Inorganic and Organic Compounds,* (3d ed).

If vapor pressure depression less than the minimum levels specified herein is employed, the solute is too insoluble to provide the elevated temperatures needed for this invention.

An additional preferred characteristic of the chemical susceptors of this invention is that the combination of the solute and the polar solvent together is more lossy than either the solute alone or the solvent alone.

Each of the components of the chemical susceptor will now be discussed in detail.

Of course, the selection of the solute and the polar solvent for that solute should be such that the two are compatible with each other in the sense that the solvent should be relatively inert with respect to its chemical reactivity with respect to the solute. The most preferred polar solvent is water and much of the description hereinafter will be given with respect to water as the polar solvent. However, it is to be understood that other polar solvents can also be employed.

The solute materials which may be used in this invention have in common each of the characteristics previously mentioned herein. Classes of materials which fall in this category include certain inorganic acids and bases such as potassium hydroxide, phosphoric acid and sulfuric acid and additionally, the most preferred solute materials which are inorganic salts. As evident from the example, mixtures of such salts can also be employed. Preferably the salts are Group IA or Group IIA salts, but other salts may be employed such as iron salts. Examples of suitable inorganic salts which have been employed for the chemical susceptors of this invention include lithium chloride, lithium bromide, calcium chloride, calcium bromide, sodium nitrite, potassium nitrite, magnesium chloride, and ferric chloride. However, it is to be understood that other representative salts from Groups IA, IIA and VIIIB may also be employed such as beryllium salts, strontium salts, certain water soluble barium salts, and nickel and cobalt salts.

With respect to the anion of these salts, there does not appear to be any criticality, with the exception of the fact that the anion should be one which will form a highly soluble salt with the cation and which will remain chemically inert at the temperature range of operation. Suitable anions can be found amongst the halides, nitrates, nitrites, phosphates, phosphites, sulfates and so forth.

With respect to employment of water as the polar solvent, each of the salts specifically mentioned herein can be further characterized as being ionic, having the ability to form water hydrates, and having fairly high water solubility at room temperature, and a significantly increased water solubility at 100° C. in comparison with their water solubility at room temperature, 20° C. In this regard, it should be noted that, for example, sodium chloride is not operable in this invention in that it does not meet the defined characteristics with respect to vapor pressure depression and solubility characteristics mentioned herein, nor does it achieve the results of the invention.

The most preferred class of inorganic salts for employment in this invention are those which exist in an anhydrous form as well as having the ability to form hydrates. Perhaps the most notable example meeting these criteria is calcium chloride which may exist in the anhydrous form, the monohydrate, the dihydrate form, the tetrahydrate form, and the hexahydrate form. As heretofore mentioned, the polar solvent employed in this invention may be present in the form of a hydrate relationship with respect to the inorganic salts. Indeed, it has been found in most instances preferable that it so exist.

Speaking with particular reference to employment of water as the polar solvent of this invention, most of the inorganic salts described herein have the further capability of having a paste like form when mixed with amounts of water up to an equal weight basis with the inorganic salts. This is desirable in that such paste-like materials can be easily applied to a holder for the susceptor. Thus, they are readily usable in disposable package forms. Moreover, as to those which form hydrates, after the paste-like slurry is formed, an equilibrium is reached between the various hydrate forms and the material becomes hardened and readily adheres to the susceptor substrates of the holder.

Turning now to a description of the polar solvents which can be employed in this invention, as heretofore mentioned, the most preferred polar solvent is water. However, other polar solvents may also be employed, particularly where nonfood uses are contemplated, and such polar solvents include ethyl alcohol, acetonitrile, dimethylsulfoxide, acetone, tetrahydrofuran and the like.

As heretofore mentioned, the solvent must be one which is compatible with the solute material. Compatability as used herein means that it will not chemically interact with the solute material in order to change the chemical composition of the solute at elevated temperature. Further, for food use, the solvent should be one which is non-toxic to the consumer, and ideally produces little or no distinctive odor.

It is not known for certain why the solvent must be a polar solvent; however, this has been found to be a critical aspect of the invention. While not desiring to be bound by any theory, it is believed that polarity of the solvent is important in that polar solvents, when excited by heating, will in association with the inorganice salts undergo dielectric orientation relaxation as phase changes occur, resulting in part in the heating profile phenomena which are discussed hereinafter.

As heretofore mentioned in a preferred aspect of this invention, the chemical susceptors usable herein include not only the two components, i.e., the solute material and the polar solvent for the solute material, but can also include a third component heating profile modifier. The heating profile modifier can be selected from the group consisting of clays, carbohydrates, titanium dioxides, fats, and silica compounds, and other classes of materials as well. Generally speaking, the heating modifier is preferred to be a silicate such as silica gel. The reason for preference of a heating modifier such as silica gel is that it does not discolor upon subjection to elevated temperatures. Such heating profile modifiers, as will be explained hereinafter with particular reference to the examples, have been found, to change the heating profile of the chemical susceptors as measured on a time/temperature graph. They have the ability of sustaining the duration of the maximum temperature achievable; in some instances they change the rate at which the maximum temperature is obtained, and often minimize the time lag before temperature elevation of the chemical susceptor begins to occur. This last property is referred to as "the firing temperature" at which the chemical susceptor begins its work. Many such modifiers, whether carbohydrates or silicates such silica gel, have in common the characteristic of modifying the water-holding capacity or heat-conductivity of the chemical susceptor, thereby altering the rate of the removal of the polar solvent as the temperature is elevated. It is believed that this is the manner in which the heating profile modifier works. The most preferred heating profile modifiers are silica gel, and micro-crystalline cellulose such as that sold under the trademark Avicel.

The amount of the heating profile modifier in the chemical susceptor composition may vary from 0.1% by weight to about 25% by weight of the total weight and preferably is within the range of from about 0.2% by weight to about 10% by weight of the total weight. Within these broad and preferred ranges, the precise amount in any given formulation will vary depending upon the heating profile curve desired. For water systems, it has been found desirable to use heating profile modifiers which are hydrophilic such as Avicel and silica gel.

With respect to the two major components of the chemical susceptor formulations of this invention, namely the solute material and the polar solvent, it is preferred that the solute material comprises from about 30% to about 85% by weight of said chemical susceptor and preferably comprises from about 45% to about 80% by weight of said chemical susceptor, the balance being solvent. In this regard, it is to be noted that the chemical susceptors of this invention are to be distinguished from dilute solution of solute material, such as inorganic salts, in the solvent material, such as water. Such highly dilute solutions do not provide the requisite vapor pressure depression, and do not provide the necessary lossy characteristics of being initially susceptible to microwave energy, followed by substantial microwave transparency. In this regard, attention is directed to the examples which show that with respect to salt hydrate systems as the chemical susceptors of this invention, it is not uncommon to have a 1:1 weight ratio of solute to solvent. The minimum amounts of solute present has been expressed herein on occasion as a sufficient amount to provide at least a saturated solution, with the understanding that substantially increased amounts are most commonly employed, particularly with respect to salt hydrate systems.

As mentioned, this invention has substantially broader applicability than microwave heating of food products. It may be employed in almost any situation where rapid heating to provide drying of materials is desired. It may, for example, by employed for drying of films, drying of cement or concrete, drying of epoxies, certain medical uses which employ the need for drying agents, rubber curing, pasteurization, veneer drying, paper drying, sealing of plastic films, and the like.

It is not known why the chemical susceptors of this invention behave in the unique manner in which they do. However, what is known is that in fact they rapidly reach (in a microwave energy environment) a maximum temperature and then, like an inherent turn off switch is present, they continually become less lossy and eventually, substantially microwave transparent. This in turn allows the temperature of the chemical susceptor to significantly drop. This characteristic is employed in the chemical susceptors of this invention.

While applicants do not wish to be bound by any theory of how the invention operates, it is believed, at least with respect to salt hydrate systems, which employ as a third component a heating modifier, at least three phenomena are occurring.

A measure of microwave lossyness is the absorption coefficient, a term used in the art referred to by the Greek letter $\alpha$ (Alpha). This term relates power absorbed to microwave power being transmitted through a material. It is a description of the lossy characteristic of any material. For details with regard to a description of the term $\alpha$ as it applies to microwave products, see *Dielectrics and Waves,* A. Von Hippel, MIT Press 1954, pg. 28.

Generally low loss refers to an $\alpha$ value of less than about 0.01 per cm, medium loss to a value within the range of 0.01 to 1.00 per cm. and high loss to a value of greater than 1.00 per cm, typically that of water.

In the first instance, using as an example a salt hydrate system of an equilibrium balance between calcium chloride and its di-, tetra- and hexahydrates, upon subjection to microwave energy radiation, since both the calcium chloride and the water of hydration are themselves somewhat lossy, heating will begin to occur. During this heating phenomena excitation of the polar solvent molecules in the hydrate system begins to occur, causing a rotational excitation of the polar molecules. As these polar molecules move upon subjection to the electromagnetic radiation, there is some relaxation which occurs causing energy to be absorbed. It is for this reason that polar solvents are believed to be essential to the chemical susceptors of this invention. As the boiling point of the solvent, in this case water, is reached, the solvent material begins to be driven off, leaving the salt material, in this case calcium chloride, initially in a more concentrated solution, and finally in the form of an anhydrous salt solid. The highly ionizable salt material will eventually change to a liquid phase and it is believed some heating occurs by ionic conduction. Eventually when most of the water of hydration leaves, a maximum temperature is achieved which is a characteristic of the particular salt employed. After achieving this maximum temperature with all polar solvent now being driven off, the salt itself in its anhydrous form, when in solid phase, becomes at least substantially microwave transparent, and the temperature achieved begins to decrease. It is this internal shut-off mechanism which is used to regulate or control the heating profile. If on the other hand, a heating profile modifier is present, such as silica gel, this makes the removal of the last residual traces of solvent more difficult, and thus the time/temperature relationship is extended making the duration at elevated temperatures somewhat longer.

It can therefore be seen that a unique method of heating profile modification has been provided. The maximum temperature achievable is dependent on the solute material used, and the polar solvent employed. The time duration at any given temperature can be modified by utilization of a heating profile modifier such as silica gel. Moreover, it is apparent that the combination of these components in the chemical susceptor provides an unexpected characteristic. The salts by themselves, absent any polar solvent, are substantially microwave transparent. The polar solvents themselves, such as water, have only a medium lossy characteristic at the microwave frequencies of interest ($\alpha$ value of 1.0 per cm at 2.45 gigahertz). Yet the combination of the two will have substantially increased lossy characteristics ($\alpha$ value above 1.00 per cm at 2.45 gigahertz) over either the solvent alone or the salt alone; and, importantly the compositions will provide the substantially increased lossy characteristics for only a minimal period of time, at which point the composition again becomes substantially non-lossy. Finally, the characteristics of the chemical susceptor, such as a salt hydrate system, can be modified by utilization of a heating profile modifier, which modifies the solvent-holding capacity and heat conductivity, resulting in changing of the heating profile characteristics. It can therefore be seen that a highly useful new technology has been developed for use with microwave energy.

As heretofore mentioned, one of the objects and advantages of this invention is that heating profile characteristics can be changed by several different means. One mentioned previously is the employment of heating profile modifiers. There are, however, other embodiments of the invention wherein the chemical susceptor can be employed in a manner which does not involve the so-called internal shut-off mechanism. While the internal shut-off mechanism has distinct advantages, particularly in employment of the invention in cooking operations, there may well be instances where a desired sustained temperature could be employed.

Generally, it has been found that the so-called internal shut-off mechanism occurs when elevated temperatures are reached such that all of the polar solvent is driven off from the solute, leaving solid phase solute which is microwave transparent. However, by controlling the amount of available power such that the microwave energy into the system equals the heat being transferred out of the system, it is possible to have sustained heating at a defined elevated temperature.

For example, if a means is provided for solvent reflux which prevents the solvent from totally leaving the system, the chemical susceptor composition will not become microwave transparent. As a result, sustained heating can occur since the liquid phase will remain present indefinitely.

In another mode of operation to achieve the sustained steady state temperature, it has been found that at least some of the salts, when reaching temperatures in excess of their melting point, will again become lossy and if sustained at a temperature above their melting point will remain lossy until cooled sufficiently to return to the solid phase. Thus, if the microwave energy input is sufficiently high to provide elevated temperatures at or above the fusion point for the salt, or solute, sustained heating will occur. An additional manner of achieving the anhydrous salt melt phase is by employing a combination of salts which will melt at a lower temperature than either of the individual salts. For example, a calcium chloride-lithium bromide (4:1–37% water) mixture has been observed to provide sustained heating at 470° C. for indefinite periods of time.

Therefore, while the primary portion of the description of this invention deals with employing compositions which never achieve the anhydrous salt melt phase, and which become microwave transparent once the solid phase is achieved, it also is to be understood that in certain instances, if desired, steady state heating can be achieved if the temperature reached by the salt solute mechanism is above the melting point of the anhydrous salt. Thereafter, heating will continue as long as the salt melt remains fused.

As will be apparent to one of ordinary skill in the art, the chemical susceptor of this invention and the manipulation of the formulation of that chemical susceptor in order to provide any given desired heating profile, may be used in a variety of differing contexts with regard to microwave energy. One context in which the invention may be used is in the development of a disposable microwave package having particular adaptability for use in vending machines or sale of prepackaged items for reheating use by the consumer. FIGS. 1, 2, 3, 4, and 5 illustrate one type of disposable package use of the chemical susceptors of this invention.

The package 10 is preferably comprised of a container formed from a microwave low-lossy material at least on one side of the package 10. Such materials may be paperboard or plastic with solid bleached sulfate paperboard being satisfactory. The package includes four sidewalls 12, 14, 16, and 18, an integral bottom wall 20 and a top wall 22. Front side wall 18 as can be seen, is formed from integrally associated top flap 23 and bottom flap 24 and corresponding side flaps 26 and 28. Top flap 23 is hinged to top wall 22 and correspondingly bottom flap 24 is hinged to bottom wall 20 and in like manner side flaps 26 and 28 are hinged to sidewalls 12 and 14, respectively. Thus, top flap 23 and bottom flap 24, as well as side flaps 26 and 28 may be folded to a closed position and adhered in that position with a suitable adhesive material.

When the package 10 is used for food use, it is preferred that it be bleached food grade paperboard. Of course, as those skilled in the art will realize, the package may be wrapped with cellophane or other protective flexible sheet materials (not specifically shown in the drawings). Such sheet materials may include any well known packaging film such as nylon, polyester, polystyrene, wax paper, and the like. These are used to protect the package during storage and are removed prior to placing the package in the microwave oven.

Figure 2:
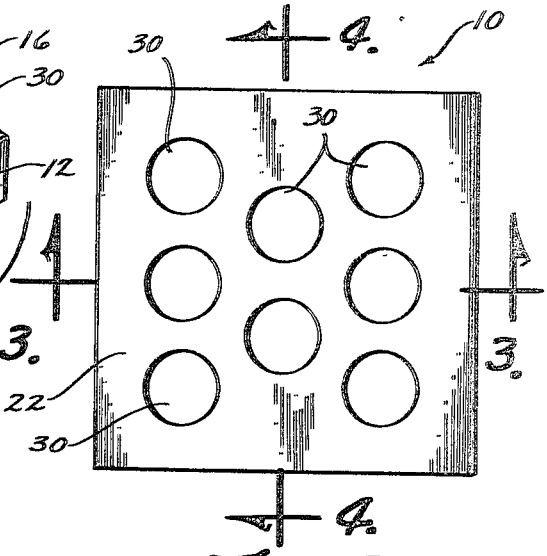
FIG. 2 is a plan view of the package shown in FIG. 1.

As can be seen in FIGS. 1 and 2, top wall 22 is shielded and includes a plurality of top surface openings 30 which are of a sufficiently small size to restrict or prevent microwaves from entering therethrough. Generally, it has been found that if it is desired to restrict microwave penetration through a shielded top, openings 30 should be no greater than one-tenth the length of the microwaves. Suitable openings can be 1.2 centimeters in diameter or less. The holes 30 thus allow the escape of moisture from the package 10 and restrict the entry of microwave radiation to prevent exposing the top of the food to microwave radiation from above.

Figure 3:
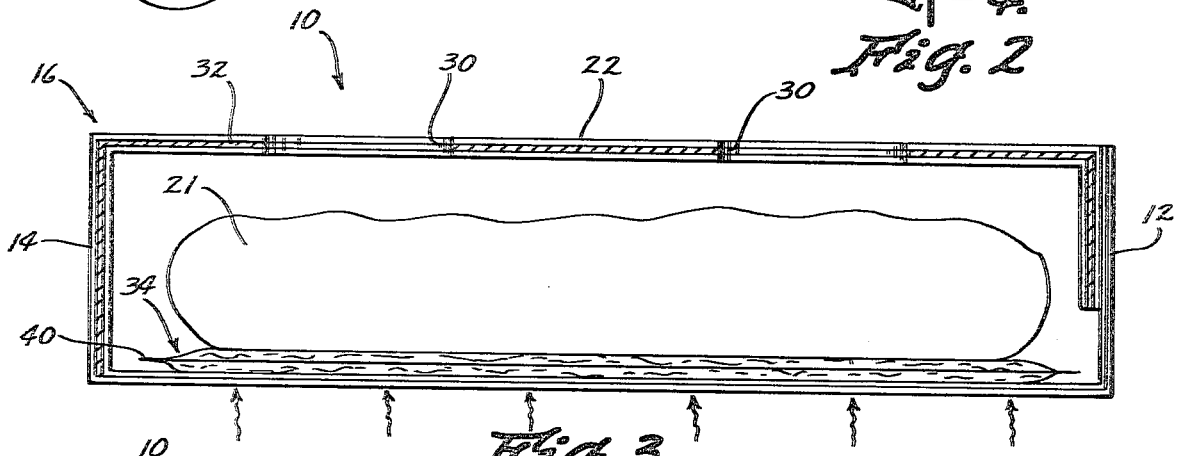
FIG. 3 is a sectional view of the package of this invention along line 3—3 of FIG. 2.
Figure 4:
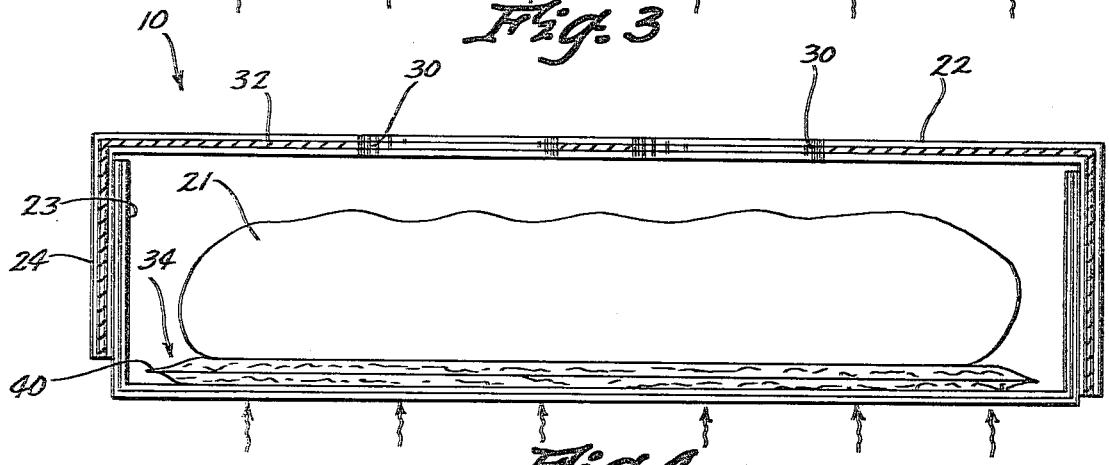
FIG. 4 is a sectional view of the package of this invention along line 4—4 of FIG. 2.
Figure 5:
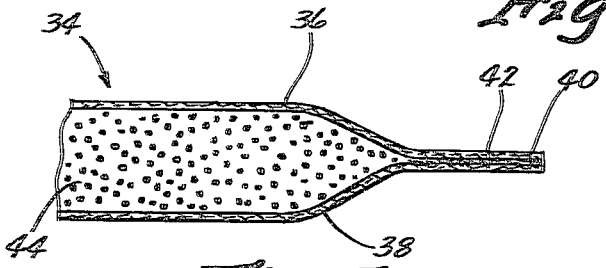
FIG. 5 is an elevated, exploded sectional view of the chemical susceptor package shown in FIG. 1, taken along line 5—5 of FIG. 1.

Accordingly if shielding is desired to prevent excessive microwave penetration to the top of a food product which might be placed in package 10, top wall 22 may have embedded therein a microwave partial shield such as an aluminum foil shield 32. As shown in FIG. 3, shield 32 is embedded in top wall 22 and side walls 12 and 14 as well as back wall 16. It should, however, be understood that the partial shield is not an essential part of the package, such a microwave shield being desirable or not desirable depending upon the ultimate use for the package. Such shields as aluminum foil shield 32 act as a barrier to prevent microwave penetration through certain surfaces of the package. As a result, utilization of shielding as described with regard to the package shown in FIGS. 1, 2, 3, 4 and 5 will concentrate the largest source of microwaves penetrating the package in a directional fashion so that they will penetrate upwardly from the bottom of the package. This is especially desirable if one's objective is to crisp the bottom surface of a food product which might be placed in the package, such as a single slice portion of pizza.

The composite package includes a susceptor insert pouch 34 which acts as a holder for the chemical susceptor. The susceptor pouch 34 is comprised of a pair of sheet materials, at least one of which is substantially microwave transparent, for example, silicone coated parchment sheets 36 and 38 which have their peripheral edges referred to generally at 40, bonded together, for example, by a suitable adhesive 42.

Prior to bonding of top and bottom sheets 36 and 38, the top surface of bottom sheet 38 is preferably coated with a paste-like portion of the chemical susceptor 44. This may be spread manually, it may be done with a blade device, or by a variety of other suitable coating techniques. After the bottom sheet 38 is smeared with the chemical susceptor 44, top sheet 36 is placed thereover, the peripheral edges 40 are preferably coated with adhesive bonding agent 42, and sealed.

It is desirable that insert pouch 34 be made from substantially grease-resistant sheet material, such as silicone coated parchment, in order to prevent sticking of a food product which might be placed on top sheet 36. It is also desirable if insert pouch 34 has at least one intentionally weakened seal in order to allow escape of vapor phase solvent by blowing the weak seal to allow venting therefrom.

The holder for the chemical susceptor preferably is a material which will not itself selectively heat to prevent activation of the susceptor. Generally low loss holder materials should be used.

Insert pouch 34 filled with the desired chemical susceptor agent 44 may be simply placed inside of package 10 resting on the top surface of bottom wall 20, or alternatively, it may be bonded by spot adhesive to bottom wall 20. The food product which is to be heated in the package is then simply placed on top of insert pouch 34.

Since many of the chemical susceptors 44 are dessicants, in order to provide storage stability, top and bottom sheets 36 and 38 of insert pouch 34 preferably is made of moisture impervious material.

It is, of course, to be understood that insert pouch 34 is only one embodiment which may be employed in packages of this invention. It is, for example, conceivable that an insert cavity for chemical susceptor 44 may be built directly into bottom wall 20 and integrally associated therewith.

In actual use the disposable package operates as follows. The overwrap for package 10 is removed. A single portion food product 21 is assumed to be inside the package 10 and it will be assumed that such product is a single slice portion of pizza. The package 10 containing the single slice portion of pizza is then placed inside a microwave oven and subjected to a source of microwave energy radiation. The microwaves cannot easily penetrate openings 30 and are unable to penetrate through aluminum foil shield 32, in those instances which employ shielding. As a result, the microwave energy is directionally controlled to enter through the bottom wall 20. The microwaves entering through bottom wall 20 pass through a non-lossy sheet of the pouch 34 and impinge upon the chemical susceptor 44. Of course, microwave radiation can also impinge directly upon the pizza portion and begin heating it. Chemical susceptor 44 acts in the manner previously described herein and heats to its maximum temperature at which time the internal shut-off mechanism occurs, and the temperature of the chemical susceptor 44 begins decreasing. However, since the chemical susceptor 44 is substantially more lossy than the food material, the maximum temperature obtained by chemical susceptor 44 is considerably higher than the temperature obtained by most portions of the food product. This elevated temperature selectively heats the bottom surface of the food product with which it is in thermal contact. As a result, higher temperatures are achieved, more surface dehydration occurs, and browning and crisping occurs. Moisture is vented from insert pouch 34 by an intentionally weakened seal and moisture from the chemical susceptor 44 which becomes vaporized is vented out of pouch 34 and out of package 10 through openings 30. After use, the package 10 and pouch 34 are discarded.

It should be understood that heating of a single slice pizza portion is mentioned herein for illustrative purposes only. Other food products which may be readily adaptable for use with disposable packages of the general type mentioned herein include french fries, breads, sandwiches, meat pies, turnovers, crispy snack foods, cakes, biscuits, popcorn, and many others.

The majority of the discussion presented has dealt with manipulation of formulation and control of chemical susceptor characteristics in order to provide satisfactory heating to achieve the desired product characteristics. The product itself may also be controlled in terms of certain fundamental heat load characteristics in order to achieve optimum performance with the chemical susceptors of this invention. Generally, it has been found that manipulation of product formulation to provide low effective heat capacity by using lower than normal moisture contents and lower than normal density will aid in their regard. As earlier mentioned with regard to packaging description, insulation may also be used in order to limit heat transfer to the environment.

For food products the chemical susceptors of this invention seem to have particular advantages. First, they are economical. Second, they provide rapid crisping in the area of contact with the pouch 34 containing the chemical susceptor 44. They provide a product which is not soggy, and importantly the chemical susceptor itself determines maximum achieved temperature and the temperature profile within the package.

The thickness of the chemical susceptor layer 44 within insert pouch 34 is important. The thickness correlates to volume and the more volume, the more heat required to heat the chemical susceptor. Also, the thicker the chemical susceptor, the more microwave radiation absorbed and the more solvent which is available to be driven off. Thus, a balance is desired to achieve the desired time temperature profile. Thicknesses within the range of 0.025 centimeters up to 0.10 centimeters have been tested and found satisfactory. However, it is generally preferred that the maximum thickness be about 0.05 centimeters. It is important that the chemical susceptor 44 be distributed uniformly over the layer of substrate material 38 upon which it rests. Otherwise, poor crisping is achieved for the product. It is also important that the pouch be formed quickly in order to prevent moisture pick up where inorganic dessicant type salts such as calcium chloride are employed.

The microwave heating performance of the chemical susceptors of this invention have generally been studied by three different yet related procedures.

In one procedure, heating of the chemical susceptor, such as salt hydrate mixture occurs in a 1,000 watt Litton microwave oven. Typically, a 100 gram sample is used and the temperature is measured at intervals during which the microwave power is turned off.

In a second system, the chemical susceptor mixture is spread between two sheets of paper, placed into a package with the product, and the package is heated in a microwave oven. The packages used were packages shown in FIGS. 1, 2, 3, 4, and 5. Evaluation of the products thus prepared and the results indicate the effectiveness of the chemical susceptor as a microwave heater. Typically, for a piece of 12 cm. by 12 cm. square pizza, 6.4 grams of the chemical susceptor mixture material was used and the oven was 650 watt microwave with heating for three minutes. For a french fries package, delivering 71 grams of the product, two 10 gram inserts, one on top and one on the bottom of the fries was used.

Finally, heating temperature profiles were extensively studied in an S band wave guide (Genesys instrument) at 200 watts. Such an instrument is well known and comprises a metallic wave guide tube with microwaves from a magnetron being directionally sent through the tube from the entrance end towards a microwave sink at the opposite end of the tube. Located in the middle of the tube is a sample insert wherein the sample which is to be studied is placed, along with a temperature sensing thermocouple. When microwave energy is passed through the wave guide tube, because

EXAMPLES 16-20

The following examples illustrate the use of Avicel as a heating profile modifier.

TABLE V

| ($CaCl_2$ with 6-10% Avicel and various % $H_2O$) | | | |
|---|---|---|---|
| Sample | % $H_2O$ | % $CaCl_2$ (Anhydrous) | % Avicel |
| 16. | 24.5 | 68.5 | 7 |
| 17. | 30.0 | 63.0 | 7 |
| 18. | 39.3 | 54.7 | 6 |
| 19. | 45.0 | 50.0 | 5 |
| 20. | 49.3 | 45.7 | 5 |

TABLE VI

| Sample | T °C. 30 sec. | T °C. 60 sec. | T °C. 90 sec. |
|---|---|---|---|
| 16 | 135 | 163 | 187 |
| 17 | 93 | 138 | 165 |
| 18 | 127 | 159 | 168 |
| 19 | 110 | 143 | 168 |
| 20 | 98 | 131 | 166 |

As can be seen, Avicel modifies the heating profile characteristics in a similar fashion to Hylon VII starch. Avicel, however, has the disadvantage compared with silica gel in that it chars upon reaching the elevated temperatures, and in similar fashion so do other starch materials. It is therefore preferred to employ silica gel.

EXAMPLES 21-23

The following examples illustrate the use of silica gel as a heating profile modifier.

TABLE VII

| Sample | % $H_2O$ | % $CaCl_2$ (Anhydrous) | % Silica gel |
|---|---|---|---|
| 21. | 28.0 | 63.7 | 4.7 |
| 22. | 36.6 | 57.7 | 5.7 |
| 23. | 47.6 | 47.6 | 4.8 |

TABLE VIII

| Sample | T °C. 30 sec. | T °C. 60 sec. | T °C. 90 sec. |
|---|---|---|---|
| 21 | 127 | 162 | 166 |
| 22 | 93 | 142 | 155 |
| 23 | 88 | 121 | 131 |

As seen, silica gel functions effectively as a modifier. It offers the further advantage that no charring of the susceptor occurs.

EXAMPLES 24-34

In the following example, french fries were prepared and evaluated by microwave heating in a Sharp Microwave oven (650 watt) utilizing the chemical susceptors shown in the table. The susceptor was placed on the top and bottom of the french fries, providing as much contact as possible on surface areas between the french fries and the susceptor. The french fries were first par fried to 65% moisture and then further fried to a moisture content of 45% but not to complete cooking. Identical french fries prepared in this manner were used for each of the following tests. In the table below (Table IX) the formulation for the susceptor is given. In columns which are blank, it should be understood that the blank means no such ingredient was employed. The heating profile modifiers utilized were Avicel, cornstarch, silica or fats labeled "Av" which were a mixture of animal and vegetable oil, and finally, stearine. The product eating quality was evaluated on an arbitrary scale by experts with 1 being minimally acceptable and 5 being the best product, which compares favorably with completely cooked french fries prepared in the conventional manner, such as deep frying.

TABLE IX

| FRENCH FRY EVALUATION | | | | | | | | |
|---|---|---|---|---|---|---|---|---|
| | | | | Percent Additives | | | | |
| Samp. | % $CaCl_2$ or (alternate) (Anhydrous) | % LiCl or (alternate) (Anhydrous) | % $H_2O$ | Avicel | Silica | Av.- (animal-vegetable oil) | Stearine | Eating Quality Evaluation |
| 24. | 30.0 | | 20.0 | | | 25.0 | 25.0 | 2 |
| 25. | 30.0 | | 20.0 | | | 37.5 | 12.5 | 4 |
| 26. | 61% ($CaBr_2 \cdot 2H_2O$) | | 32.0 | 7.0 | | | | 2 |
| 27. | | 59.2 | 35.0 | 5.8 | | | | 5 |
| 28. | 55.5 | | 38.8 | 5.7 | | | | — |
| 29. | 57.6 | | 36.6 | 5.8 | | | | 5 |
| 30. | 76.0 | | 24.0 | | | | | 1 |
| 31. | 70.9 | | 22.0 | | 7.1 | | | 4 |
| 32. | 53.2 | 5.9 | 35.0 | 5.9 | | | | 2 |
| 33. | 47.3 | 11.8 | 35.0 | 5.9 | | | | 3 |
| 34. | 29.6 | 29.5 | 35.0 | 5.9 | | | | 4 |

At can be seen, those products prepared utilizing the chemical susceptors of this invention, particularly those employing modifiers in order to modify the heating profile of the chemical susceptor, most nearly approached ordinary french fries in terms of their quality evaluation. In Examples 24, 26, 30 and 32, low eating quality does necessarily not reflect upon performance of the susceptor but merely indicates under or over cooking.

EXAMPLES 35-81

In the following series of Examples, chemical susceptors in accordance with this invention were utilized in a susceptor pouch 34 in a package as described in FIGS. 1, 2, 3, and 4 of the drawings for pizza evaluation. The pizza utilized was a single slice portion measuring about 12 cm. by 12 cm.

TABLE X

| Sample | % $CaCl_2$ (Anh) | % LiCl (Anh) | LiBr (Anh) | % $H_2O$ | % Avicel | % Cornstarch | Eating Quality Rating |
|---|---|---|---|---|---|---|---|
| 35 | 53.7 | | 5.9 | 34.5 | 5.9 | | 3 |
| 36 | 47.3 | | 11.8 | 35.0 | | | 3 |
| 37 | 63.3 | | | 30.0 | | 6.7 | 5 |
| 38 | 53.5 | | | 40.0 | | 6.5 | 4 |
| 39 | 43.5 | | | 50.0 | | 6.5 | 3 |
| 40 | 33.5 | | | 60.0 | | 6.5 | 2 |
| 41 | 25.0 | | | 70.0 | | 5.0 | 1 |

of the microwave sink downstream from the sample insert, the microwave energy can pass only a single time through the sample. Thus, the temperature is dependent upon inherent lossy characteristics of the material.

While the data of these various studies are tabulated in the examples, some observations can be particularly noted at the outset; First, of all the salt hydrates which may be employed, calcium chloride, calcium bromide, lithium chloride lithium bromide and magnesium chloride appear to be the most effective salt hydrate system microwave heaters.

These salts, like all of the other chemical susceptors mentioned herein, may be used either singly or in combination.

Secondly, where water is the polar solvent, the amount of water in the mixture influences the heating profile by two different mechanisms. At low temperature, the water content determines the availability of liquid phase, and thus determines the lower temperature limit at which any particular mixture still may function as a microwave heater. When the mixture is heated to elevated temperature, the evaporation of water in the system influences the rate of temperature rise. Thus, higher moisture levels will slow the heating rate when all other factors are kept constant.

Thirdly, heating profile modifiers will alter not only the heating profile, but also the maximum temperature achievable. The rheology of the mixture is also altered by heating profile modifiers. The exact mechanism of the heating profile modifier influence is not clear. However, it is known that all materials which have an affinity for water and/or which make water more difficult to remove from the system may be used as modifiers. It is believed that they serve as a moisture sink at low temperatures and at higher temperatures the water may be released to a salt hydrate susceptor, for example, and thus prolong the time the mixture stays at elevated temperatures.

EXAMPLE 1-5

In this example, the heating rate of calcium chloride in its various hydrate systems was studied in a microwave oven 1000 watt Litton system, 100 gram samples were used and the temperature was measured at 30, 60, and 90 second time intervals. The samples employed were as follows:

TABLE I

| Sample | % $H_2O$ | % Calcium Chloride (anh) |
|---|---|---|
| 1. | 24.5 | 75.5 (dihydrate)* |
| 2. | 30 | 70.0 |
| 3. | 39.3 | 60.7 (tetrahydrate)* |
| 4. | 45 | 55.0 |
| 5. | 49.3 | 50.7 (hexahydrate)* |

(*based on storchiometry)

The results of these tests are set forth in the table below:

TABLE II

| Sample No. | T 30 sec. | T 60 sec. | T 90 sec. |
|---|---|---|---|
| 1. | 27° C. | 29° C. | 32° C. |
| 2. | 82° C. | 127° C. | 171° C. |
| 3. | 77° C. | 93° C. | 129° C. |
| 4. | 49° C. | 66° C. | 82° C. |
| 5. | 43° C. | 54° C. | 66° C. |

In this series of examples, as well as all others presented, the concentration of solute was sufficient to depress the vapor pressure at the boiling point of the solvent by more than 50%.

In Table I it can be seen that generally as solute concentration increases, maximum temperature attained is higher but when there is no liquid phase present, as in the dihydrate case, little heating effect is observed.

EXAMPLES 6-15

The heating range of calcium chloride with added Hylon VII starch as a heating profile modifier, was studied. Hylon VII starch contains about 70% amylose. The manner of testing was exactly as described previously in Example 1-5. The formulations prepared were as follows:

TABLE III

| CaCl $2H_2O$ hydrates with added Hylon VII starch | | | |
|---|---|---|---|
| Sample | % $H_2O$ | % Hylon VII | % $CaCl_2$ (Anhydrous) |
| 6. | 24.5 | 2 | 73.5 |
| 7. | 30.0 | 2 | 68.0 |
| 8. | 39.3 | 2 | 58.7 |
| 9. | 45.0 | 1 | 54.0 |
| 10. | 49.3 | 1 | 49.7 |
| 11. | 24.5 | 5 | 70.5 |
| 12. | 30 | 4 | 66.0 |
| 13. | 39.3 | 4 | 56.7 |
| 14. | 45 | 4 | 51.0 |
| 15. | 49.3 | 3 | 47.7 |

These samples were then tested in order to determine heating rate. The results of this testing are set forth in Table IV below.

TABLE IV

| Sample | T °C. 30 sec. | T °C. 60 sec. | T °C. 90 sec. |
|---|---|---|---|
| 6 | 30 | 93 | 156 |
| 7 | 116 | 143 | 172 |
| 8 | 59 | 98 | 138 |
| 9 | 60 | 96 | 127 |
| 10 | 60 | 88 | 121 |
| 11 | 60 | 107 | 154 |
| 12 | 115 | 138 | 163 |
| 13 | 69 | 92 | 138 |
| 14 | 72 | 99 | 122 |
| 15 | 71 | 89 | 110 |

It should be understood that with regard to some of the temperatures given in Table IV, as well as other tables appearing herein, those are not actual measured temperatures, but are interpolated temperatures provided from graphs prepared from actual temperatures measured at different time intervals. The reason for the interpolation is that not all measurements were made exactly at 30, 60 and 90 seconds, but the values for comparison purposes are given herein at 30, 60 and 90 second intervals.

As can be seen, Tables III and IV, show that with the addition of starch, as a modifier, there seems to be a minimization of the difference between the temperatures attained by various hydrate forms of calcium chloride. It is believed that the reason for this is that the starch profile modifier has some moisture which becomes available to the system at higher temperatures and also increases the rate of heating initially.

Other examples have been run utilizing the addition of silica gel, and/or of micro-crystalline cellulose materials. The data is consistent with the conclusion that by the addition of a heating profile modifier such as starch or micro-crystalline cellulose such as Avicel, one increases not only the maximum temperature attainable but also the heating rate.

TABLE X-continued

| | | | | | | | | |
|---|---|---|---|---|---|---|---|---|
| 42 | 63.3 | | | 30.0 | | 6.7 | | |
| 43 | 33.5 | | | 60.0 | | 6.5 | | |
| 44 | 54.5 | | | 38.8 | | 6.7 | | |
| 45 | 63.3 | | | 30.0 | 6.7 | | | |
| 46 | 33.5 | | | 60.0 | 6.5 | | | |
| 47 | 54.5 | | | 38.8 | 6.7 | | | |
| 48 | 58.5 | | 6.5 | 35.0 | | | | 3 |
| 49 | 52.0 | | 13.0 | 35.0 | | | | 5 |
| 50 | 52.5 | | 6.5 | 35.0 | 6.0 | | | 3 |
| 51 | 52.5 | 6.5 | | 35.0 | 6.0 | | | 4 |
| 52 | 46.0 | | 13.0 | 35.0 | 6.0 | | | 4 |
| 53 | 46.0 | 13.0 | | 35.0 | 6.0 | | | 3 |
| 54 | 52.5 | | 6.5 | 35.0 | | 6.0 | | 3 |
| 55 | 52.5 | 6.5 | | 35.0 | | 6.0 | | 4 |
| 56 | 46.0 | | 13.0 | 35.0 | | 6.0 | | 3 |
| 57 | 46.0 | 13.0 | | 35.0 | | 6.0 | | 4 |
| 58 | 51.2 | 12.8 (NaCl) | | 30.0 | 6.0 | | | 2 |
| | | | | | Silica | $CaSO_4$ | $TiO_2$ | |
| 59 | 44.0 | | | 40.0 | | 6.0 | | 4 |
| 60 | 44.0 | | | 40.0 | 6.0 | 6.0 | | 4 |
| 61 | 44.0 | | | 40.0 | | | 6 | 3 |
| 62 | 44.0 | | | 50.0 | 6* | | | 3 |
| 63 | 44.0 | | | 50.0 | 6** | | | 4 |
| 64 | 68.1 | | | 31.9 | | | | 2 |
| 65 | 57.4 | | | 42.6 | | | | 4 |
| 66 | 46.8 | | | 53.2 | | | | 2 |
| 67 | 64 | | | 30 | 6 | | | 3 |
| 68 | 54 | | | 40 | 6 | | | 2 |
| 69 | 44 | | | 50 | 6 | 3 | | |
| 70 | 64 | | | 30 | 6 | | | 2 |
| 71 | 54 | | | 40 | 6 | | | 2 |
| 72 | 44 | | | 50 | 6 | | | 5 |
| 73 | 54.5 | 13.6 | | 31.9 | | | | 3 |
| 74 | 45.9 | 11.5 | 42.6 | | | | 3 | |
| 75 | 37.5 | 9.3 | 53.2 | | | | 3 | |
| 76 | 51.2 | 12.8 | | 30 | | | | 5 |
| 77 | 43.2 | 10.8 | | 40 | 6 | | | 3 |
| 78 | 35.2 | 8.8 | | 50 | 6 | | | 3 |
| 79 | 51.2 | 12.8 | | 30 | | 6 | | 3 |
| 80 | 45.1 | 10.8 | | 40 | | 6 | | 3 |
| 81 | 35.2 | 8.8 | | 50 | | 6 | | 4 |

*6% Syloid 266
**Colloidal Silica

Again the quality evaluation scale was found from minimum acceptability (1) to good (5) and 5 is a composite measure of those qualities the consumer generally finds most acceptable in cooked pizza, namely, lack of sogginess, good crispness, moisture retained in the pizza topping and so forth. Again, as can be seen, those products using the chemical susceptors of this invention, and particularly those utilizing heating profile modifiers showed acceptability nearly as great or as great as conventionally cooked pizza.

EXAMPLES 82–97

In the following series of examples, the heating profile of salt hydrates was measured in a Genesys wave guide instrument. The temperature readings were measured in thermocouple milliwatts and those readings thereafter converted to temperatures according to conventional tables which are readily available. The thermocouple was placed in a stainless steel capillary tube which in turn was embedded in the sample mixture and positioned perpendicular to the microwave electric field protruding through the S-band waveguide and parallel to the longer side. It continuously monitored the temperature of the sample.

Figure 6:
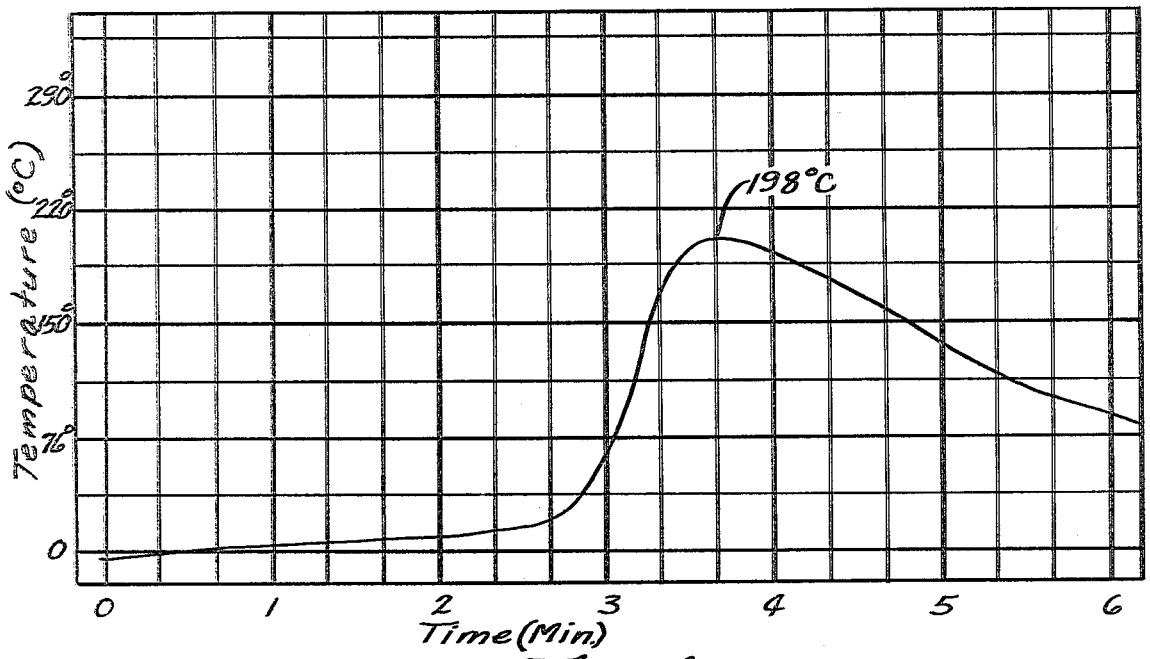
FIG. 6 is a temperature-time graph showing how a chemical susceptor of this invention modifies heating profile.
Figure 7:
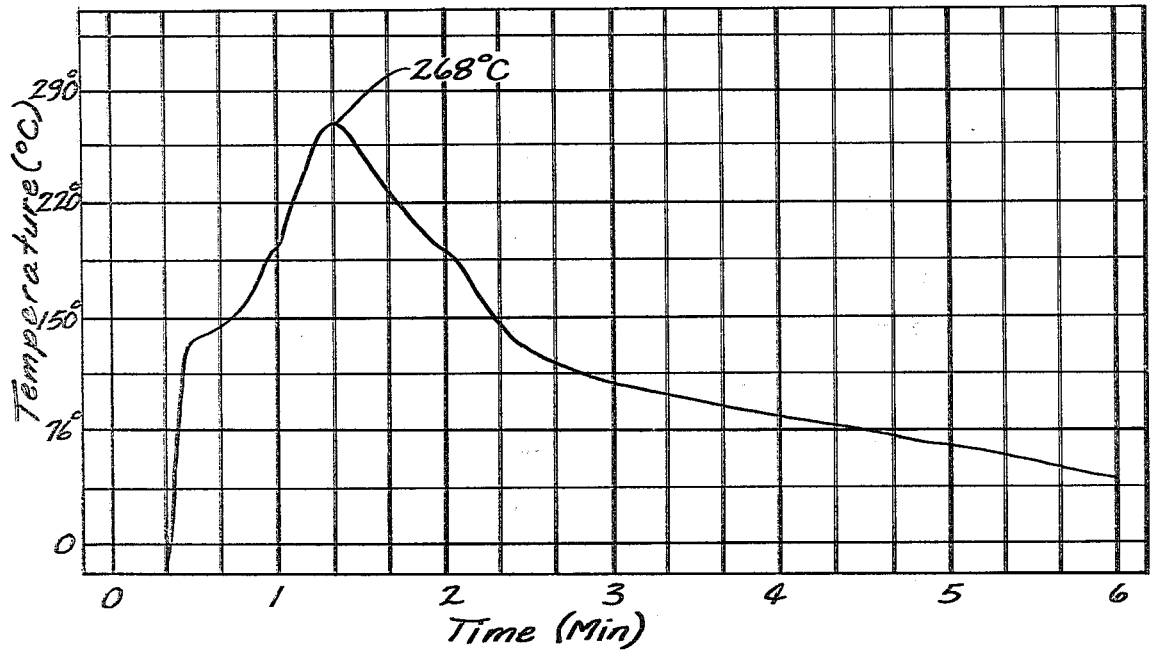
FIG. 7 is a temperature-time graph for a second embodiment of this invention.

FIG. 6 shows the time temperature profile for a chemical susceptor as depicted in Example 93. FIG. 7 shows a similar time temperature profile for the composition depicted in Example 96.

The following chemical susceptor formulations were prepared.

TABLE XI

| Sample | % $CaCl_2$ (Anh) | % $H_2O$ | % LiCl (Anh) | % Avicel | % Cornstarch | % Silica |
|---|---|---|---|---|---|---|
| 82 | 55.0 | 45.0 | | | | |
| 83 | 61.2 | 38.8 | | | | |
| 84 | 55.2 | 38.8 | | 6.0 | | |
| 85 | 55.2 | 38.8 | | | 6.0 | |
| 86 | $MgCl_2 6H_2O$ | | | | | |
| 87 | | 15.0 | 85.0 | | | |
| 88 | 70.0 | 30.0 | | | | |
| 89 | 65.0 | 35.0 | | | | |
| 90 | 70.0 | 30.0 | | | | |
| 91 | 70.0 | 30.0 | | | | |
| 92 | 50.0 | 50.0 | | | | |
| 93 | 64.0 | 30.0 | | 6.0 | | |
| 94 | 44.0 | 50.0 | | 6.0 | | |
| 95 | 64.0 | 30.0 | | | | 6.0 |
| 96 | 44.0 | 50.0 | | | | 6.0 |
| 97 | 56.4 | 30.0 | 13.6 | | | |

Time temperature profiles for each of the products are set forth in the Table XII.

TABLE XII

| SECONDS Sample: | 0 | 20 | 40 | 60 | 80 | 100 | 120 | 140 | 160 | 180 | 200 | 220 | 240 | 260 | 280 | 300 | | |
|---|---|---|---|---|---|---|---|---|---|---|---|---|---|---|---|---|---|---|
| | TEMPERATURE TIME PROFILE (degrees centrigrade) | | | | | | | | | | | | | | | | | |
| 82 | | 27 | 139 | 161 | 215 | 237 | 204 | 179 | 164 | 154 | 135 | 132 | 123 | 117 | 115 | 114 | | |
| 83 | | 27 | 106 | 186 | 258 | 222 | 197 | 179 | 157 | 132 | 126 | 121 | 117 | 114 | | | | |
| 84 | | 27 | 150 | 190 | 193 | 186 | 175 | 154 | 135 | 114 | | | | | | | | |
| 85 | | 27 | 31 | 157 | 186 | 182 | 182 | 175 | 168 | 157 | 143 | | | | | | | |
| 86 | | 27 | 58 | 65 | 65 | 62 | 50 | 47 | 43 | | | | | | | | | |
| 87 | | 27 | 197 | 197 | 161 | 143 | 132 | 121 | 117 | 113 | 110 | | | | | | | |
| 88 | | 27 | 29 | 161 | 208 | 204 | 158 | 114 | 95 | 85 | 81 | 77 | | | | | | |
| 89 | | 24 | 26 | 95 | 204 | 212 | 186 | 150 | 118 | 106 | 99 | 93 | 89 | | | | | |
| 90 | | 8 | 10 | 12 | 114 | 176 | 190 | 204 | 190 | 154 | 125 | 106 | 95 | 85 | 81 | 73 | | |
| 91 | | <0 | <0 | <0 | <0 | <0 | <0 | <0 | <0 | <0 | <0 | <0 | <0 | <0 | <0 | <0 | | |
| 92 | | 4 | 150 | 176 | 150 | 114 | 91 | 81 | 77 | 73 | 73 | 71 | 69 | 67 | 58 | 54 | | |
| 93 | | <0 | 0 | 0 | 4 | 4 | 6 | 8 | 12 | 20 | 95 | 186 | 198 | 188 | 172 | 150 | 128 | 110 |
| 94 | | <0 | 140 | 176 | 182 | 182 | 170 | 132 | 106 | 93 | 85 | 79 | 75 | 65 | 58 | 54 | | |
| 95 | | <0 | <0 | <0 | <0 | 0 | 6 | 58 | 148 | 186 | 236 | 244 | 226 | 190 | 150 | 122 | 140 | |
| 96 | | <0 | 142 | 190 | 268 | 234 | 198 | 150 | 122 | 110 | 99 | 91 | 87 | 81 | 73 | | | |
| 97 | | <0 | <0 | <0 | <0 | <0 | <0 | <0 | 168 | 204 | 240 | 114 | 178 | 154 | 132 | 110 | | |

As earlier mentioned, FIG. 6 provides the time temperature profile set forth in the immediately preceding table for Example 93 in graph form. FIG. 7 presents a time temperature graph for Example 96. As can be seen, Example 93 and FIG. 6 correspond to a product which is comprised of 64% calcium chloride, 30% water in the hydrate form, and 6% Avicel. Example 96 corresponds to a product which is 44% calcium chloride, 50% hydrate of water, and 6% silica. In comparing these with others not using a modifier, it can be seen how the addition of the heating profile modifiers substantially changes the time temperature relationship. Moreover, the graphs shown in FIGS. 6 and 7 vividly demonstrate how the product fairly quickly obtains a maximum temperature and as the product becomes substantially non-lossy due to loss of the solvent component, its temperature decreases.

In certain of the examples shown, such as Examples 1 and 91, it can be seen that in some instances, in the absence of any liquid phase with a solid salt, no substantial heating effect is achieved.

EXAMPLES 98–106

The procedure of Examples 82 through 97 was repeated with sample formulations given in Table XIII below:

TABLE XIII

| | COMPOSITION BY WEIGHT PERCENT | | | | | | |
|---|---|---|---|---|---|---|---|
| Sample | $CaCl_2$ (Anh) | $MgCl_2$ (Anh) | LiCl (Anh) | LiBr (Anh) | Avicel | Silica Gel | $H_2O$ |
| 98 | | | | 80 | | | 20 |
| 99 | 40 | | 10 | | | | 50 |
| 100 | 51.2 | | 12.8 | | 6 | | 30 |
| 101 | 35.2 | | 8.8 | | 6 | | 50 |
| 102 | 51.2 | | 12.8 | | | 6 | 30 |
| 103 | 35.2 | | 8.8 | | | 6 | 50 |
| 104 | | 46.9 | | | | | 53.1 |
| 105 | 19.4 | 33.3 | | | | | 47.3 |
| 106 | 37.7 | 16.2 | | | | | 46.1 |

The time temperature profile as measured in the wave guide instrument for Examples 82 through 97 was utilized in the same manner as described therein for measurements of Examples 98 through 106 and the results of these measurements are shown in Table XIV.

TABLE XIV

| | Time (Sec) | | | | | | | | | | |
|---|---|---|---|---|---|---|---|---|---|---|---|
| Sample | 0 | 20 | 40 | 60 | 80 | 100 | 120 | 140 | 160 | 180 | 200 |
| | TEMPERATURE (°C.) | | | | | | | | | | |
| 98 | 5° C. | 139 | 255 | 190 | 179 | 172 | 190 | 182 | 168 | 154 | 128 |
| 99 | 0° C. | 92 | 103 | 114 | 139 | 169 | 154 | 126 | 104 | 95 | 91 |
| 100 | −8° C. | 27 | 183 | 204 | 200 | 180 | 170 | 155 | 139 | 128 | 108 |
| 101 | −6° C. | 128 | 175 | 164 | 166 | 164 | 157 | 150 | 146 | — | — |
| 102 | −6° C. | 143 | 280 | 476 | 479 | 439 | 376 | 294 | 222 | 199 | 177 |
| 103 | −6° C. | 128 | 184 | 224 | 177 | 150 | 137 | 123 | 99 | 82 | — |
| 104 | 0° C. | 10 | 186 | 214 | 214 | 186 | 114 | 86 | 67 | — | — |
| 105 | 10° C. | 20 | 154 | 204 | 177 | 159 | 136 | 114 | 109 | 104 | 95 |
| 106 | 0° C. | 10 | 24 | 150 | 195 | 209 | 240 | 240 | 204 | 186 | 168 |

As can be seen, a safe, effective, efficient method for formulation control in order to manipulate the temperature profile in a product placed in a microwave field has been achieved. Thus, the invention accomplishes at least all of its stated objectives.

What is claimed is:

1. A lossy susceptor device for microwave energy, which upon continued heating by exposure to microwave radiation has a chemical susceptor portion which becomes substantially microwave transparent, said susceptor device comprising: a chemical susceptor comprising a combination of a solute and a polar solvent for said solute, the amount of solute present being as a minimum an amount which will depress the vapor pressure of said solvent, at least by 25% when compared to said solvent's boiling point at standard pressure; and a holder for said chemical susceptor said holder including vent means which permits escape of solvent from the holder when said chemical susceptor is exposed to microwave radiation.

2. The chemical susceptor of claim 1 wherein the solute is present in at least a minimum amount sufficient to provide a eutectic mixture of said solute in said solvent.

3. The chemical susceptor of claim 2 wherein the solute is present in at least a minimum amount sufficient to provide a saturated solution, at room temperature, of said solute in said solvent.

4. The chemical susceptor of claim 3 wherein the combination of solute and polar solvent is more lossy than either the solute alone or the solvent alone.

5. The chemical susceptor of claim 3 wherein said vapor pressure of said solvent is depressed at least 50%.

6. The chemical susceptor of claim 3 wherein said vapor pressure of said solvent is depressed of about 70% or greater.

7. The chemical susceptor of claim 3 wherein said vapor pressure of said solvent is depressed in the range of between about 70% and about 80%.

8. The chemical susceptor of claim 3 wherein said solute is an inorganic salt material.

9. The chemical susceptor of claim 8 wherein said inorganic salts are selected from the group consisting of Groups IA and IIA salts, of mixtures thereof.

10. The chemical susceptor of claim 9 wherein said salts are Group IA and IIA salts which when mixed with said polar solvent become paste-like.

11. The chemical susceptor of claim 10 wherein said salts are salts capable of forming water hydrates.

12. The chemical susceptor of claim 8 wherein said polar solvent for said solute is water.

13. The chemical susceptor of claim 10 wherein said salts are Groups IA and IIA inorganic salts which significantly increase their solubility in water at 100° C. in comparison with their water solubility at 20° C.

14. The chemical susceptor of claim 13 wherein said salts are capable of forming water hydrates.

15. The chemical susceptor of claim 14 wherein said polar solvent for said solute is water.

16. The chemical susceptor of claim 12 wherein said salts are Groups IA and IIA inorganic salts which significantly increase their solubility in water at 100° C. in comparison with their water solubility at 20° C.

17. The chemical susceptor of claim 3 wherein said chemical susceptor includes a heating profile modifier in an amount of from about 0.1% by weight to about 25% by weight of chemical susceptor.

18. The chemical susceptor of claim 17 wherein said heating profile modifier is present at a level of from about 0.2% by weight to about 10% by weight of chemical susceptor.

19. The chemical susceptor of claim 17 wherein said heating profile modifier is an additive which makes said polar solvent more difficult to remove from said system during heating.

20. The chemical susceptor of claim 19 wherein said heating profile modifier is hydrophilic.

21. The chemical susceptor of claim 20 wherein said heating profile modifier is selected from the group consisting of clays, carbohydrates, titanium dioxides, fats, and silicates.

22. The chemical susceptor of claim 12 wherein said salt comprises from about 30% to about 85% by weight of said susceptor.

23. The chemical susceptor of claim 22 wherein said salt comprises from about 45% to about 80% by weight of said chemical susceptor.

24. The chemical susceptor of claim 9 wherein said salt is calcium chloride.

25. The chemical susceptor of claim 9 wherein said salt is lithium chloride.

26. The susceptor device of claim 3 wherein said holder includes a pair of sheet members with at least a portion of the one said sheet member being substantially microwave transparent, said chemical susceptor is interposed between the sheet members, said sheet members being secured to one another substantially enclosing the chemical susceptor, vent means for allowing the venting of the solvent from the holder during heating of the chemical susceptor.

27. The susceptor device of claim 26 wherein both of said sheet members are substantially microwave transparent and said chemical susceptor is adhered to at least one of said sheet members.

28. The susceptor device of claim 1 wherein said device is positioned adjacent a food product whereby said chemical susceptor is in heat transfer relationship with said food product and will heat said food product upon exposure to micowave radiation.

29. The susceptor device of claim 1 positioned in a microwave radiation field sufficiently strong to cause said chemical susceptor to heat.

30. The susceptor device of claim 1 wherein said holder is of a low lossy material.

31. The susceptor device of claim 1 wherein said holder substantially encloses the chemical susceptor and has at least one substantially microwave transparent portion.

32. The susceptor device of claim 1 wherein the thickness of the chemical susceptor is up to about 0.1 centimeters.

33. A lossy susceptor device for microwave energy, which upon continued exposure to microwave radiation has a chemical susceptor portion which becomes substantially microwave transparent, said susceptor device comprising: a low lossy holder for said chemical susceptor, and a chemical susceptor in heat transfer association with said holder comprising an inorganic salt selected from Group IA and Group IIA salts in combination with water as a polar solvent for said salts, and a heating profile modifier, the amount of said salt being sufficient to depress the vapor pressure of water at least by 25% when compared to the vapor pressure of water at standard pressure, said holder including vent means which permits escape of solvent from the holder when said chemical susceptor is exposed to microwave radiation.

34. The chemical susceptor of claim 33 which comprises about 45% by weight calcium chloride as the inorganic salt, about 45% by weight and about 10% by weight silica gel as a heating profile modifier.

35. A method of microwave heating products which simultaneously heats internal portions of said product and selectively raises to a higher temperature preselected areas of said products, said method comprising: locating a lossy susceptor device in a microwave environment, said susceptor device including a chemical susceptor comprising a solute and a polar solvent for said solute, the amount of said solute being as a minimum an amount sufficient to provide a saturated solution of said solute in said polar solvent and an amount which will depress the vapor pressure of said solvent at least 25% when compared to the vapor pressure of said solvent at its boiling point at standard pressure, placing said product which is to be heated in heat transfer association with at least a portion of said susceptor device, and exposing said susceptor device to microwave radiation energy to heat said chemical susceptor, said chemical susceptor being heated to a higher temperature than said product until said polar solvent is driven off, and thereafter said chemical susceptor becoming substantially non-lossy.

36. A disposable package for use in microwave ovens, said package comprising: a container of substantially non-lossy material for holding of a product to be treated with microwave radiation, and a chemical susceptor for microwave energy associated with said container for thermal contact with at least one surface of a product which is to be placed in said container, said chemical comprising an inorganic salt selected from the group consisting of Group IA and Group IIA salts, and a polar solvent for said salt, and a low lossy substantially microwave transparent holder surface for said susceptor.

37. The package of claim 36 wherein said package includes on selected surfaces a microwave shield to directionally control the microwave exposure.

38. The package of claim 37 wherein said package includes on some surfaces apertures sufficiently small to at least partially restrict microwave penetration.

39. A method of microwave heating products which simultaneously heats the internal portions of said product and selectively raises to a higher temperature preselected areas of said products, said method comprising: locating a lossy chemical susceptor in a microwave environment, said chemical susceptor comprising a solute and a polar solvent for said solute, the amount of said solute being as a minimum an amount sufficient to provide a saturated solution of said solute in said polar solvent, and an amount which will depress the vapor pressure of said solvent at least 25% when compared to the vapor pressure of said solvent at its boiling point at standard pressure, placing said product which is to be treated in heat transfer association with at least a portion of said chemical susceptor and exposing said chemical susceptor to microwave radiation to heat said chemical susceptor, said chemical susceptor being heated to a higher temperature than said product, and a higher temperature than the fusion point of said solute portion of the chemical susceptor resulting in said solute portion changing to a liquid phase, and thereafter said solute portion continuing to heat in a steady state as long as said solute portion remains in said liquid phase and is exposed to sufficient microwave radiation energy to remain in said liquid phase.

40. A disposable microwave package comprising: a container of substantially non-lossy material for holding of a food product to be treated with microwave radiation energy, a chemical susceptor for microwave energy associated with said container for thermal contact with at least one surface of a product which is to be placed in said container, said chemical comprising an inorganic salt selected from the group consisting of Group IA and Group IIA salts, and a polar solvent for said salt, a low lossy substantially microwave transparent holder surface for said susceptor, a food product within said package, said food product having a low moisture content and a low density in order to change its heat load characteristics.

* * * * *